US011285354B1

(12) United States Patent
Tseng

(10) Patent No.: US 11,285,354 B1
(45) Date of Patent: Mar. 29, 2022

(54) MULTIPLE WEIGHT ADJUSTABLE DUMBBELL WITH SINGLE HAND WEIGHT SELECTION ADJUSTMENT

(71) Applicant: Cap Barbell, Inc., Houston, TX (US)

(72) Inventor: Ching-Ting Tseng, Houston, TX (US)

(73) Assignee: Cap Barbell, Inc., Houston, TX (US)

( * ) Notice: Subject to any disclaimer, the term of this patent is extended or adjusted under 35 U.S.C. 154(b) by 0 days.

(21) Appl. No.: 17/469,604

(22) Filed: Sep. 8, 2021

(51) Int. Cl.
*A63B 21/075* (2006.01)
*A63B 21/072* (2006.01)
*A63B 21/00* (2006.01)

(52) U.S. Cl.
CPC ..... *A63B 21/075* (2013.01); *A63B 21/0726* (2013.01); *A63B 21/0728* (2013.01); *A63B 21/4035* (2015.10)

(58) Field of Classification Search
CPC ..... A63B 21/0726; A63B 21/0728; A63B 21/4035; A63B 21/072–075; A63B 21/004; A63B 21/00058; A63B 21/00061; A63B 21/00065; A63B 21/06; A63B 21/0601; A63B 21/0604; A63B 21/4023; A63B 21/4033
See application file for complete search history.

(56) References Cited

U.S. PATENT DOCUMENTS

2009/0305852 A1* 12/2009 Hoglund ..... A63B 21/0728 482/107
2012/0115689 A1* 5/2012 Dalebout ..... A63B 21/0728 482/107
2013/0231224 A1* 9/2013 Svenberg ..... A63B 21/0724 482/107
2015/0360073 A1* 12/2015 Moran ..... A63B 21/0726 482/107
2017/0001061 A1* 1/2017 Marjama ..... A63B 71/0619
2018/0264308 A1* 9/2018 Wang ..... A63B 71/0036
2020/0398100 A1* 12/2020 Wang ..... A63B 21/075

* cited by examiner

*Primary Examiner* — Joshua Lee
*Assistant Examiner* — Catrina A Letterman
(74) *Attorney, Agent, or Firm* — D'Ambrosio & Menon, PLLC; Usha Menon

(57) ABSTRACT

An adjustable weight dumbbell device includes a nesting tray and a plurality of weight plates with a radial recess and positioned parallel to each other on the nesting tray. A handle with a grip is provided, wherein rotating the grip in a first direction to one of a plurality of predefined positions, after the handle has been inserted through the aligned radial recesses of the weight plates to rest on the nesting tray, results in a set of selected number of weight plates that correspond to the selected predefined position, getting engaged with the handle which results in the selected number of weight plates moving out of the nesting tray along with the handle when the handle is moved away from the nesting tray.

18 Claims, 6 Drawing Sheets

MULTIPLE WEIGHT ADJUSTABLE DUMBBELL WITH SINGLE HAND WEIGHT SELECTION ADJUSTMENT

FIELD OF THE INVENTION

The present invention relates generally to exercise equipment. In particular, it pertains to an adjustable dumbbell having a weight selection mechanism.

BACKGROUND

The background description includes information that may be useful in understanding the present invention. It is not an admission that any of the information provided herein is prior art or relevant to the presently claimed invention, or that any publication specifically or implicitly referenced is prior art.

Exercise has physical and mental health benefits. Among the various types of exercises, weight training is a form of strength training that aims to develop the strength and size of skeletal muscles. Weight training utilizes the weight force of gravity acting on physical objects to oppose the force generated by muscle. These physical objects are available in a variety of types of specialized equipment.

Free weights, such as, dumbbells, barbells, and kettlebells, are commonly used in weight training. Many users prefer to use such free weights rather than complex weight-lifting machines. A large variety of exercises may be performed using free weights. Free weights are generally less expensive, require minimal maintenance, and need less storage and usage space than other types of exercise equipment.

A dumbbell is a type of free weight usually described by two equal weights attached to a handle. Dumbbells can be used individually or in pairs, with one in each hand. There are three main types of dumbbells: fixed-weight, loadable, and selectorized.

Fixed-weight dumbbells weights have two weight heads/plates fixed to opposite ends of a handle. The weight heads can consist of cast iron or rigid plastic shell filled with concrete. These are sometimes coated with rubber or neoprene for comfort. The dumbbell ends can be circular, hex-shaped, or even square. As fixed-weight dumbbells increase in weight, they are proportionally larger in size. A full set of fixed-weight dumbbells includes dumbbells with different weight heads. The user may select the weight heads according to their exercise needs. A disadvantage of fixed-weight dumbbells is that the user may need to purchase and use many dumbbells. Also, a fixed-weight dumbbell set typically will encompass several cubic feet of storage.

Loadable dumbbells consist of a metal bar whose center portion is engraved with a crosshatch pattern to improve grip. Further, weight plates are slid onto the outer portions of the dumbbell and secured with clips or collars. Loadable dumbbells are more compact than a fixed-weight dumbbell set but still require a relatively large footprint for the weight plates.

Selectorized dumbbells are adjustable dumbbells whose number of plates or weights can be changed when resting in a dumbbell stand. The weight adjustment is achieved by altering the number of plates that follow the handle when lifted. While selectorized dumbbells overcome the disadvantage of the fixed-weight or loadable dumbbells to some extent, there are still drawbacks. Of the three types of dumbbells, selectorized dumbbells require the least amount of storage space. They are also significantly faster to adjust than loadable dumbbells. However, the weight adjustment requires the use of two hands. Two-hand adjustment is time-consuming, cumbersome, and may come at the expense of allocated exercise time. In addition, two-hand adjustment can be unsafe if the weights are not selected or secured correctly at each end by the user.

Therefore, there is a need for an improved adjustable dumbbell that overcomes the above-stated drawbacks of conventional dumbbells. In particular, there is a need for an adjustable dumbbell that simplifies the process of weight adjustment, is convenient and safe to use and store, and requires less storage space.

SUMMARY

An improved adjustable dumbbell is provided to solve the above-described limitations of conventional dumbbells presently known in the art to exercise. According to an embodiment, the disclosed dumbbell includes a nesting tray, a plurality of weight plates, and a handle with a rotating grip. The weight plates include a radial recess, and the nesting tray is configured to hold the weight plates parallel to each other such that the radial recesses of the plurality of weight plates are aligned to each other. In an aspect, the handle includes an adjustment mechanism coupled to the rotating grip such that rotating the rotating grip in a first direction to one of a plurality of predefined positions, after the handle has been inserted through the aligned radial recesses of the weight plates to rest on the nesting tray, results in a set of selected weight plates that correspond to the selected predefined position, getting engaged with the handle. The engagement results in the selected weight plates moving out of the nesting tray along with the handle when the handle is moved away from the nesting tray.

The adjustment mechanism is configured such that rotating the grip in a second direction that is opposite the first direction, to a selected position out of the plurality of predefined positions, after the handle has been inserted through the aligned radial recesses of the weight plates to rest on the nesting tray, results in the engaged weight plates that are in excess of the weight plates corresponding to the selected position, getting disengaged from the handle. The disengagement of the weight plates results in the excess weight plates remaining on the nesting tray when the handle is moved away from the nesting tray.

The nesting tray can include a plurality of slots configured to receive and hold the weight plates in parallel, vertical disposition, equally distributed on two sides of the nesting plate. There can be enough space in between the parallelly disposed weight plates to accommodate the rotating grip of the handle.

The handle can include a pair of hubs configured on two sides of the rotating handle such that the rotating grip rotates in the first direction and the second direction relative to the hubs. The hubs can be configured to rest on the nesting tray in the space between the weight plates distributed on the two sides of the nesting tray.

At least one of the hubs can include a plurality of markings corresponding to the plurality of predefined positions for the rotating grip. Each marking can include the weight of the handle as a result of the corresponding weight plates getting engaged with the handle.

The handle can include a plurality of selector plates coupled to the rotating grip for rotation along with the rotating grip. The selector plates can be located on the two sides of the handle beyond the hubs in spaced parallel disposition such that, when the handle is positioned over the nesting tray, the selector plates get located in space between adjacent weight plates concentric to the weight plates.

The selector plates can include raised tabs located on a side of the selector plates. When the selector plates rotate along with the rotating grip in the first direction, the raised tabs can engage with one or more projections on the adjacent weight plate. The engagement of the raised tabs with the projection can result in the corresponding weight plate getting coupled to the handle for moving out of the nesting tray along with the handle when the handle is moved away from the nesting tray.

The raised tabs can be progressively located on the selector plates such that additional rotation of the rotating grip by predefined angles results in an engagement of one additional weight plate with the handle on each side of the handle.

The handle can include a locking mechanism configured to lock the rotating grip with the hub in the selected position to prevent rotation of the rotating grip in the first or second direction. The locking mechanism can lock the rotating grip in the selected position when the handle is lifted off the nesting tray. On the other hand, when the handle is placed on the nesting tray, the locking mechanism can unlock the rotating grip to allow the rotating grip to be rotated in the first or second direction.

The locking mechanism can include one or more locking tabs located on an outer periphery of the hubs such that, when the handle is placed on the nesting tray, the locking tabs move radially inward to unlock the rotating grip.

The locking tabs can be spring-biased to move radially outward when the handle is moved away from the nesting tray to lock the rotating grip.

The nesting tray can also include one or more raised projections in positions corresponding to the locking tabs such that, when the handle is placed on the nesting tray, the raised projections engage with the corresponding locking tabs to move the locking tabs radially inward within corresponding locking recesses in the hubs.

The raised projections on the nesting tray and the corresponding locking recesses on the hubs can be configured such that, when the handle is placed over the nesting tray, the raised projections engage with the corresponding locking recesses to prevent rotation of the hubs as the rotating grip is rotated in the first or second direction to the selected positions. This can enable the rotating grip to be rotated by a single hand without having to hold the hubs.

The adjustment mechanism can include an electric motor to rotate the rotating grip in the first or second direction, and a control system with wireless connectivity to allow remote actuation of the electric motor to rotate the rotating grip to the first or second direction to a selected position.

An aspect of the present disclosure relates to a method for adjusting the weight of a dumbbell, the method including the steps of: (i) providing a nesting tray; (ii) arranging a plurality of weight plates on the nesting tray in a spaced parallel vertical disposition such that radial recesses provided on the weight plates are aligned to each other; and (iii) providing a handle with a rotating grip, wherein the handle includes an adjustment mechanism coupled to the rotating grip that allows selection and deselection of one or more weight plates out of the plurality of weight plates to be coupled to the handle. The method includes further steps of: (iv) inserting the handle through the aligned radial recesses of the weight plates until the handle rests on the nesting tray; and (v) rotating the rotating grip in a first direction to a selected position out of a plurality of predefined positions. The rotation of the rotating grip in the first direction results in a set of selected weight plates that correspond to the selected predefined position, getting engaged with the handle, thereby resulting in the selected weight plates moving out of the nesting tray along with the handle when the handle is moved away from the nesting tray.

The method can further include the step of: rotating the rotating grip in a second direction that is opposite the first direction, to a selected position out of the plurality of predefined positions, after the handle has been inserted through the aligned radial recesses of the weight plates to rest on the nesting tray, to disengage the engaged weight plates that are in excess of the weight plates corresponding to the selected position, getting disengaged from the handle, thereby resulting in the excess weight plates being retained on the nesting tray when the handle is moved away from the nesting tray.

The method can further include the step of: locking the rotating grip in the selected positions when the handle is lifted off the nesting tray to prevent rotation of the rotating grip in the first or second direction. The handle can include a locking mechanism configured to automatically lock the handle grip in the selected position when the handle is lifted off the nesting tray.

The method can include the step of: unlocking the rotating grip when the handle is placed on the nesting tray to allow rotation of the rotating grip in the first or second direction. The locking mechanism can be configured to automatically unlock the handle grip when the handle is placed on the nesting tray.

The method can also include the step of: allowing rotation of the rotating grip using a single hand by arresting rotation of a pair of hubs to which the rotating grip is rotatably configured. The locking mechanism can be configured to prevent rotation of the hubs when the handle is placed over the nesting tray.

Various objects, features, aspects, and advantages of the inventive subject matter will become more apparent from the following detailed description of preferred embodiments and the accompanying drawing figures in which like numerals represent like components.

DETAILED DESCRIPTION

Figure 1A:
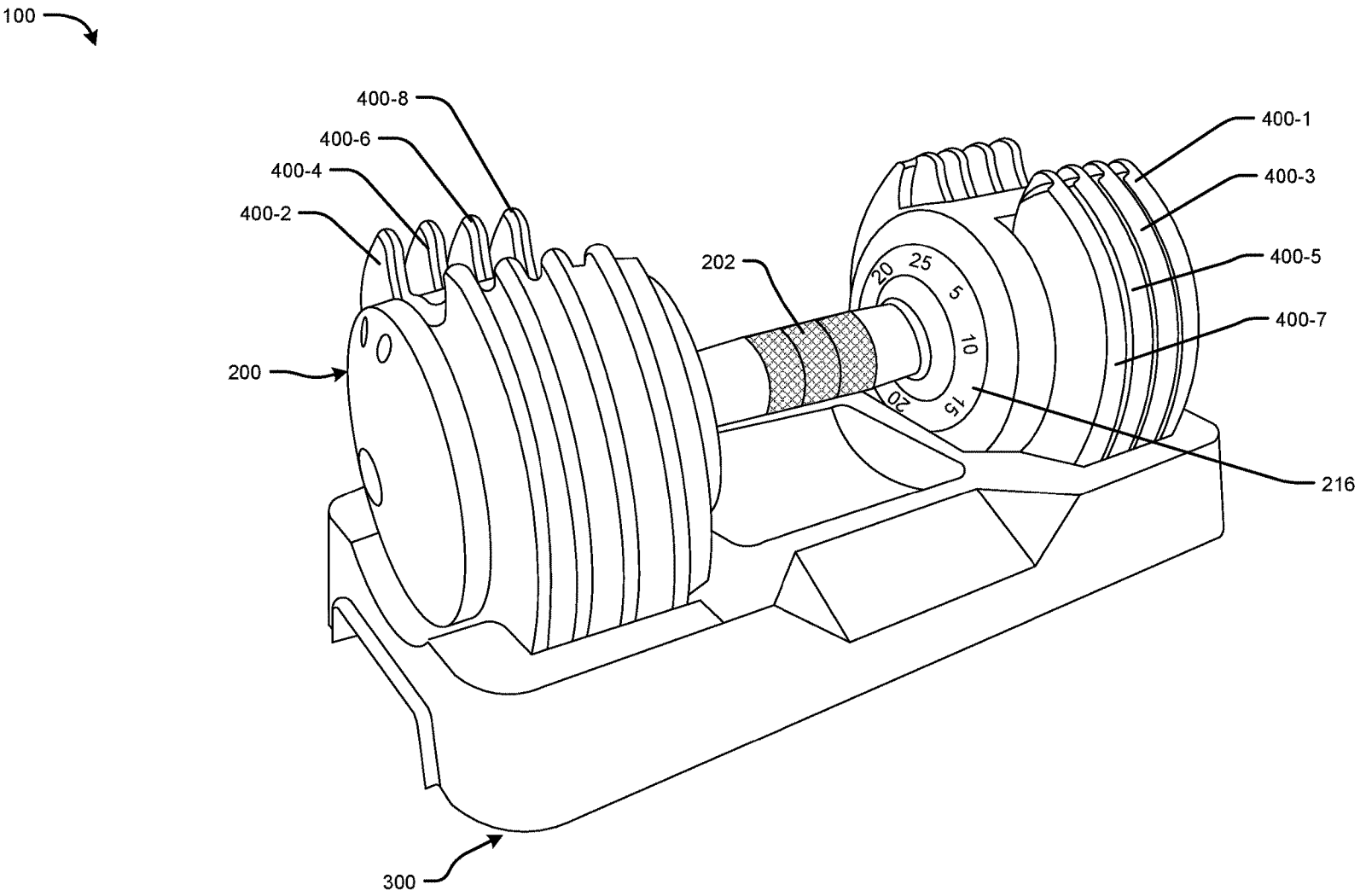
FIGS. 1A and 1B illustrate exemplary perspective views of the disclosed adjustable weight dumbbell device in accordance with embodiments of the present disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments;

on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples or exemplary language (for example, "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined, it should be given the broadest definition persons in the pertinent art have given that term as reflected in printed publications and issued patents at the time of filing.

In an embodiment, the disclosed adjustable weight dumbbell device (also referred to simply as device hereinafter) is based on an adjustment mechanism that works to select or deselect desired weights by twisting/rotating the grip of a handle in one or another direction. The adjustment mechanism includes a plurality of selector plates, coupled to the handle for rotation along with the rotatable/rotating grip, and located on two opposing ends of the handle in a spaced parallel disposition.

In an embodiment, the weights that can be selectively added are provided in the form of a plurality of weight plates. The weight plates are vertically arranged along two opposing ends of the nesting tray, in a spaced parallel disposition, with space therebetween for accommodating the handle. The weight plates include a radial recess. The handle can be placed over the nesting tray such that a shaft connecting the selector plates to the rotating grip is accommodated through the radial recesses of the weight plates to concentrically align the selector plates with the weight plates wherein the selector plates are positioned in the space between adjacent weight plates.

In an embodiment, the device includes a locking mechanism that works automatically to lock the rotation of the rotating grip as the handle is lifted off the nesting tray and unlocks the rotation of the rotating grip when the handle is placed over the nesting tray to allow rotation of the rotating grip.

Figure 1B:
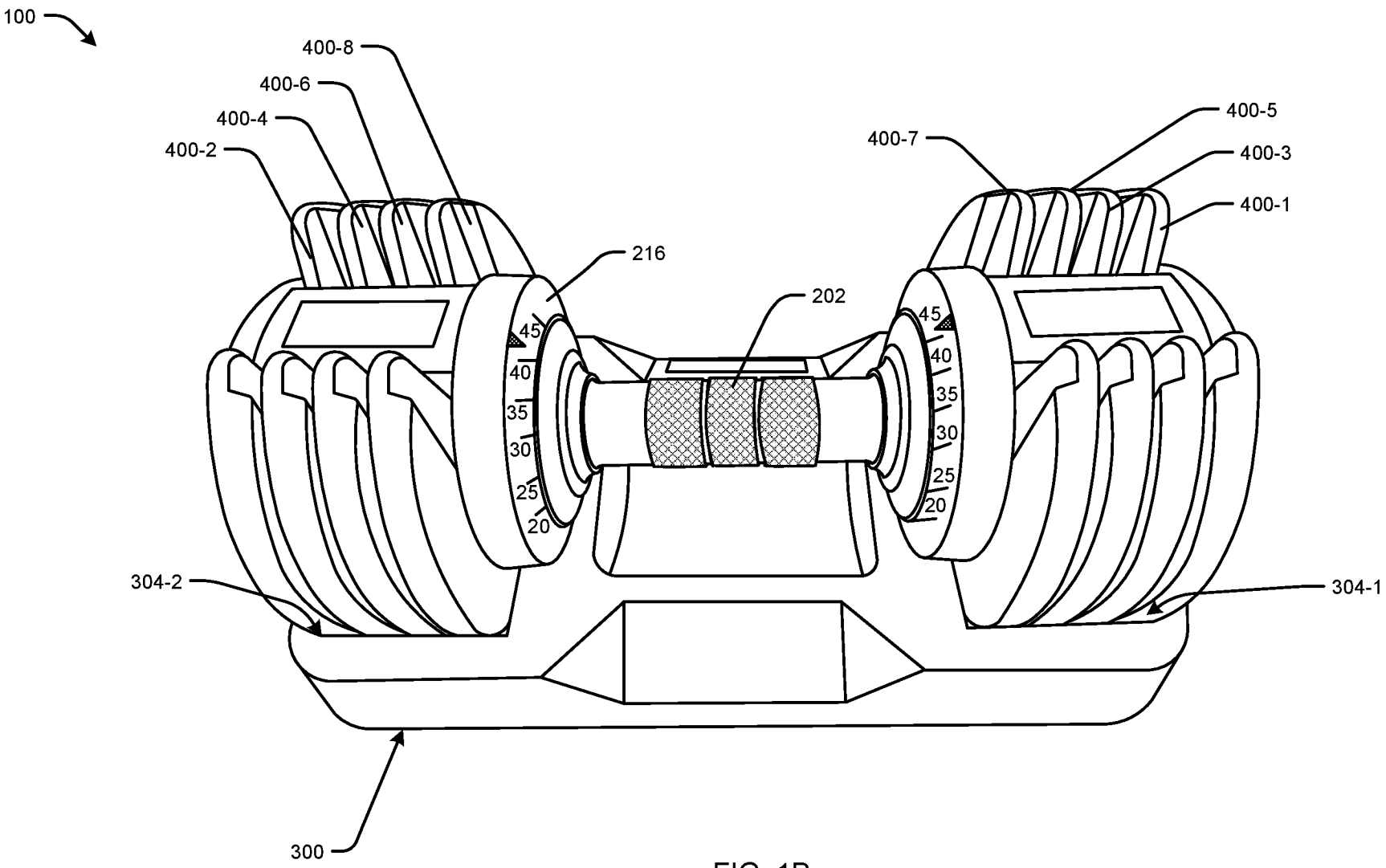

Referring now to FIGS. 1A and 1B, where perspective views of the proposed adjustable weight dumbbell device from different directions are disclosed, the adjustable weight dumbbell device 100 includes a handle 200, a nesting tray 300, and a plurality of weight plates, such as weight plates 400-1, 400-3, . . . etc. located on a first side of the nesting tray 300, and weight plates 400-2, 400-4, . . . etc. (hereinafter collectively and individually referred to as selector plate(s) 400) located on the opposite side of the nesting tray 300. As shown, the weight plates 400 can be arranged vertically, parallel to each other, and equally distributed on the two sides of the nesting tray 300 with space therebetween. A middle portion of the handle, that includes a rotating grip 202 (refer to FIG. 2), can be accommodated when the handle 200 is placed over the nesting tray 300. The handle 200 is designed to fit in the hands of a person and provide an area that the person can grip and lift the adjustable dumbbell 100.

The rotating grip 202 is the area of the handle 200 that will be in contact with a user during gripping, lifting, and exercising with the present invention. The rotating grip 202 is substantially cylindrical to allow a user to grasp it in one hand. The rotating grip 202 can be constructed of various materials that are both long-lasting and durable, such as metal, plastic, rubber, or a combination of these and other materials known in the art. The rotating grip 202 can be textured to ensure a secure grip. In an embodiment, the textured surface can extend the entire length and circumference of the rotating grip 202. In another embodiment, the textured surface can extend only a portion of the length or a portion of the circumference of the rotating grip 202. For example, the textured surface can extend four inches lengthwise and the entire circumference of the rotating grip 202. In another example, the textured surface can extend the entire length and only half the circumference of the rotating grip 202, such as the bottom side of the rotating grip 202. The textured surface can be created by etches, grooves, treatments with a friction coating, or a combination of these and other texturing techniques known in the art.

In a preferred embodiment, the rotating grip 202 can be rotated bi-directionally along a longitudinal axis, specifically clockwise and counter-clockwise (or, as described herein, in a first direction or a second direction). In another embodiment, the rotating grip 202 can be rotated in only a first or a second direction.

The rotating grip 202 (refer to FIG. 2) of the handle 200 can be rotated in a first direction to one of a plurality of predefined positions, as defined by weight selection markings shown in FIG. 1B, after the handle 200 has been placed to rest on the nesting tray 300.

The weight selection markings, such as markings 216 (also referred to simply as markings or marking and the terms used interchangeably hereinafter), indicate the weight selected by the user of the adjustable dumbbell device 100. As shown, a plurality of weight selection markings 216 can be printed on either end or both ends of the rotating grip 202. The term "print" is understood to encompass printing, etching, engraving, stamping, or any combination of these and other marking techniques known in the art. In one non-limiting embodiment, the weight selection marking 216 can begin at five pounds and can increase in five-pound increments up to twenty-five pounds. In another embodiment, the weight selection marking 216 can begin at ten pounds and can increase in five-pound increments up to fifty (or more) pounds. However, it is understood that these weight selection markings 216 are non-limiting. In one or more embodiments, the design of the weight selection markings 216 ensures that a user can view the range of weights available for selection. In one or more embodiments, the weight selection marking 216 can indicate the weight of the handle 200 along with the corresponding weight plates 400 that get engaged with the handle 200. The handle 200 can have a base weight, for example, but not limited to 5 lbs, without any weight plate 400. So, when the handle 200 is lifted, no weight plates are lifted. However, in certain embodiments the base weight of the handle 200 can include one or more weight plates on each side.

The user can rotate the rotating grip 202 to the desired corresponding weight selection. The user can lift the adjustable dumbbell 100, wherein the number of weight plates that are attached to the handle 200 is automatically configured based on the corresponding weight selection markings 216.

Rotating the rotating grip 202 results in a set of selected weight plates 400 that correspond to the selected predefined position, getting engaged with the handle 200. The engagement results in the selected weight plates 400 moving out of the nesting tray 300 along with the handle 200 when the handle 200 is moved away from the nesting tray 300.

In one or more embodiments, the beginning weight depends on the weight of the handle 200 alone, and the incremental weight additions depend on the number and weight of the weight plates 400 engaged with the handle 200. It is understood that only one weight selection can be made at a time. Further, the selected weight must be a specific interval described by a specific weight selection marking 216. For instance, if a weight selection of seven pounds is not disclosed in the range of weight shown by the weight selection markings 216, the user cannot select seven pounds. In an embodiment, the handle 200 can be locked onto the nesting tray 300 (cannot be removed or lifted) when a user attempts an inappropriate selection. In another embodiment, the handle 200 can be removed from the nesting tray 300 when a user attempts an inappropriate selection, but the handle 200 will secure only the weight plates 400 that correspond to the nearest lesser weight increment or weight selection marking 216.

In another aspect, when the rotating grip 202 is rotated in a second direction that is opposite the first direction, to a selected position out of the plurality of predefined positions, after the handle 200 has been placed on the nesting tray 300, the engaged weight plates 400 that are in excess of the weight plates 400 corresponding to the selected position, would be disengaged from the handle 200. The disengagement of the weight plates 400 results in the excess weight plates 400 remaining on the nesting tray 300, when the handle 200 is moved away from the nesting tray 300.

Figure 2:
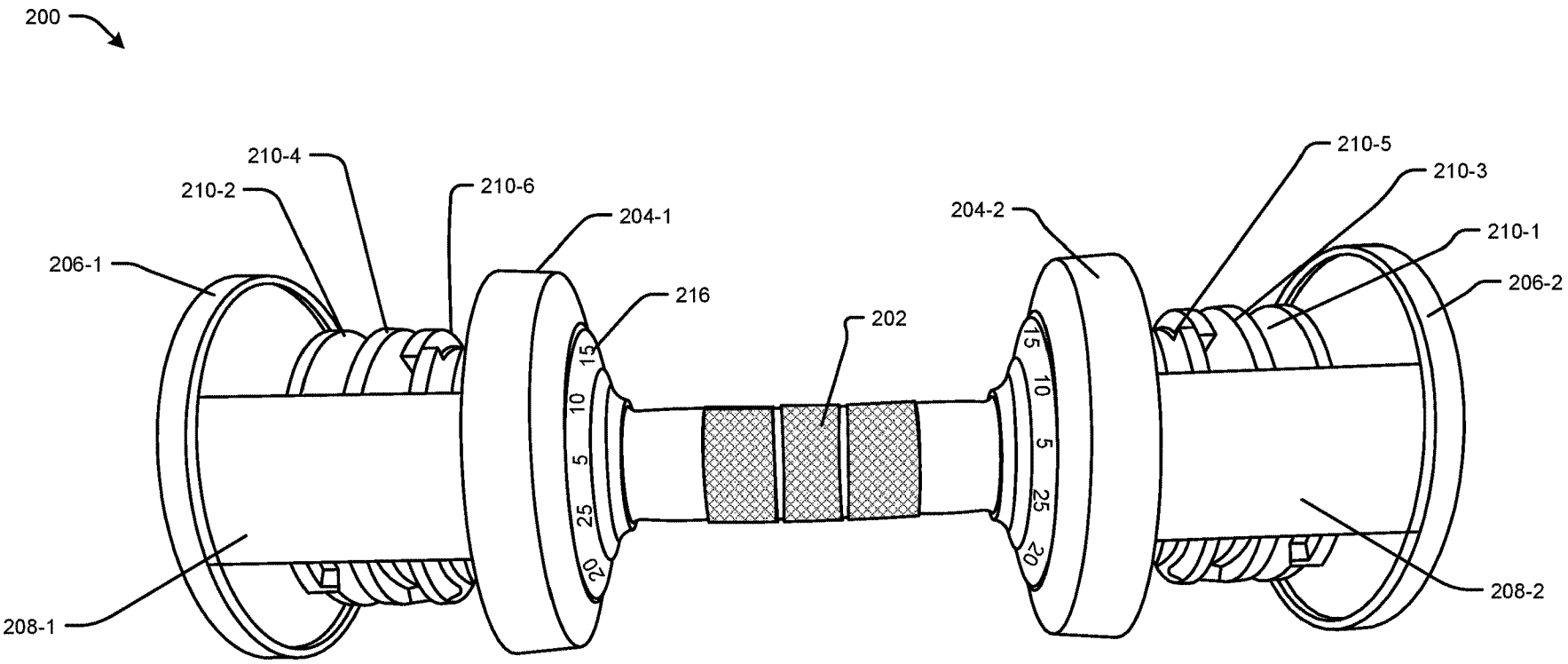
FIG. 2 illustrates an exemplary top perspective view of a handle of the adjustable weight dumbbell device in accordance with an embodiment.

FIG. 2 shows a top perspective view of the handle 200, having a rotating grip 202 located between a pair of hubs, such as a left side hub 204-1 and a right side hub 204-2 (hereinafter collectively and individually referred to as hub(s) 204), located on two sides of the rotating grip 202.

The rotating grip 202 can be configured to rotate relative to the hubs 204. The handle 200 further includes a plurality of selection plates, such as left selection plates 210-1, 210-3, . . . etc. and right side selection plates 210-2, 210-4, . . . etc. (hereinafter collectively and individually referred to as selection plate(s) 210), located on the outer sides of the respective hubs 204. The selection plates 210 can be coupled to the rotating grip 202, such as by a shaft on either side (not shown here), so that when the rotating grip 202 is rotated in a first direction or a second direction that is opposite the first direction, the selector plates 210 also rotate along with the rotating grip 202 by same rotational angle.

The handle 200 can also include a pair of end plates, such as left side end plate 206-1 and a right side end plate 206-2 (hereinafter collectively and individually referred to as end plate(s) 206), located at the extreme end of the handle 200. The end plates 206 can be coupled to the hubs 204 on the respective sides by a bridge, such as left side bridge 208-1 and a right side bridge 208-2 (hereinafter collectively and individually referred to as bridge(s) 208). Accordingly, the end plates 206 remain stationary as the rotating grip 202 is twisted/rotated. The bridges 208 can be sized to get located within an upper end of the radial recesses 402 (refer to FIG. 3) of the weight plates 400, when the handle 200 is placed over the nesting tray 300, as is evident from FIGS. 1A and 1B. The bridges 208 can also help to angularly align the weight plates 400 placed over the nesting tray 300 for satisfactory functioning of the adjustment mechanism (described in subsequent paragraphs with reference to FIG. 4) of the device 100.

Figure 3:
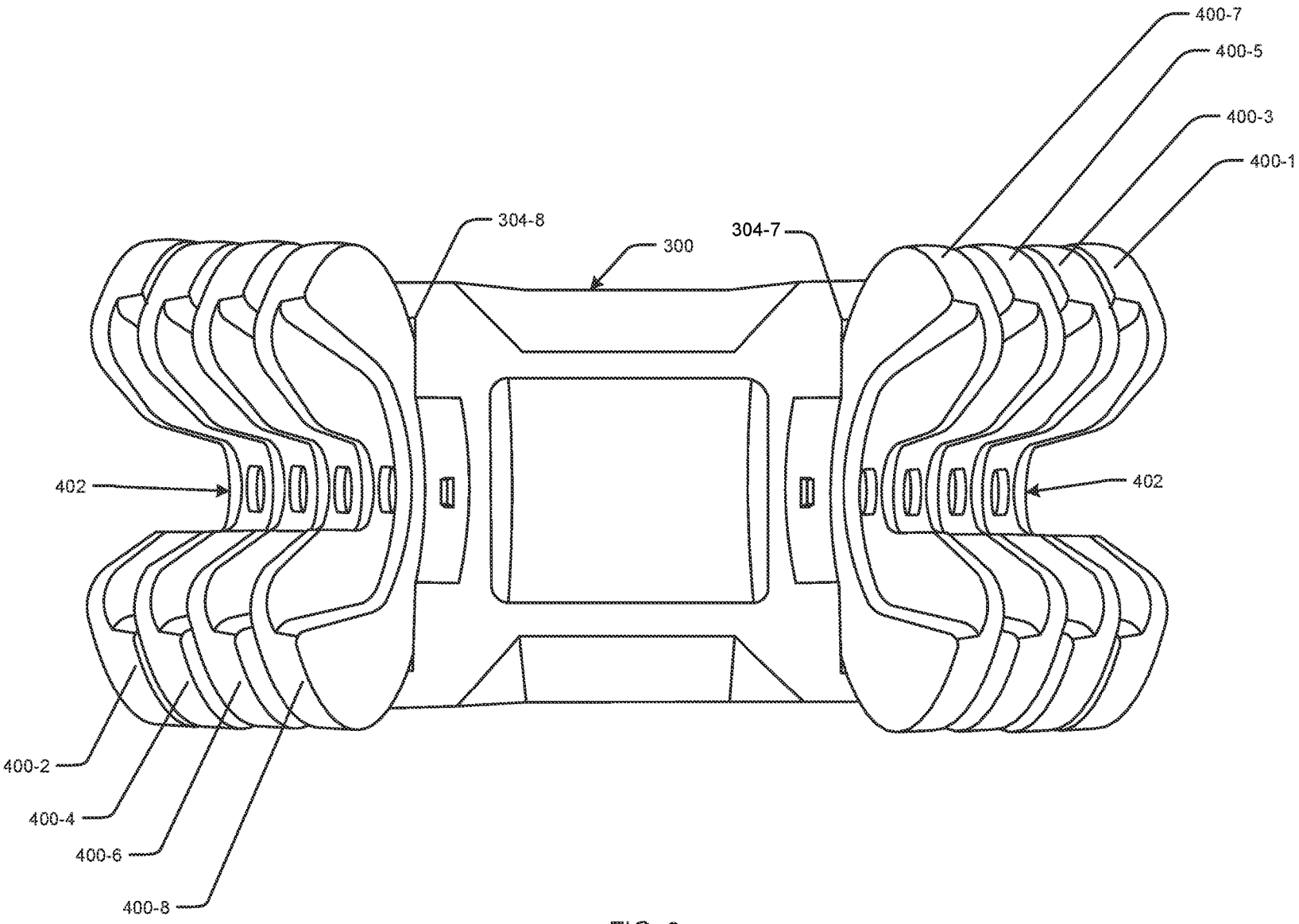
FIG. 3 illustrates an exemplary top perspective view of a nest tray along with a plurality of weight plates of the adjustable weight dumbbell device in accordance with an embodiment.

FIG. 3 shows a top perspective view of the nesting tray 300 along with a plurality of weight plates 400 positioned thereon. The nesting tray 300 can be rectangular in shape. The nesting tray 300 can include a plurality of slots, such as slots 304-1, 304-2, . . . 304-7 and 304-8 shown in FIG. 1B and FIG. 3 (hereinafter collectively referred to as receiving slots or simply as slots 304), equally distributed on the two ends of the nesting tray to receive and hold the weight plates 400 in vertical spaced and parallel disposition such that the radial recesses 402 (also referred to as recesses and the two terms used interchangeably) of the weight plates 400 are oriented generally on an upper side. Depending on the number of plates and shape of the weight plates comprising the plurality of weight plates 400, the nesting tray 300 can have corresponding receiving slots 304 located on each side of the nesting tray 300. In one embodiment, the slots 304 on the nesting tray 300 can have a semi-circular shape to complement the rounded outer edges of the weight plates 400. The nesting tray 300 can be constructed of various materials such as metal, plastic, rubber, or a combination of these and other materials known in the art.

When the handle 200 is placed over the nesting tray 300, the bridges 208 of the handle 200 can adjust the weight plates by rotation such that the radial recesses 402 are aligned to each other, which can also correspond to the correct position of the weight plates 400 for satisfactory selection/deselection by the adjustment mechanism of the handle 200.

Figure 4:
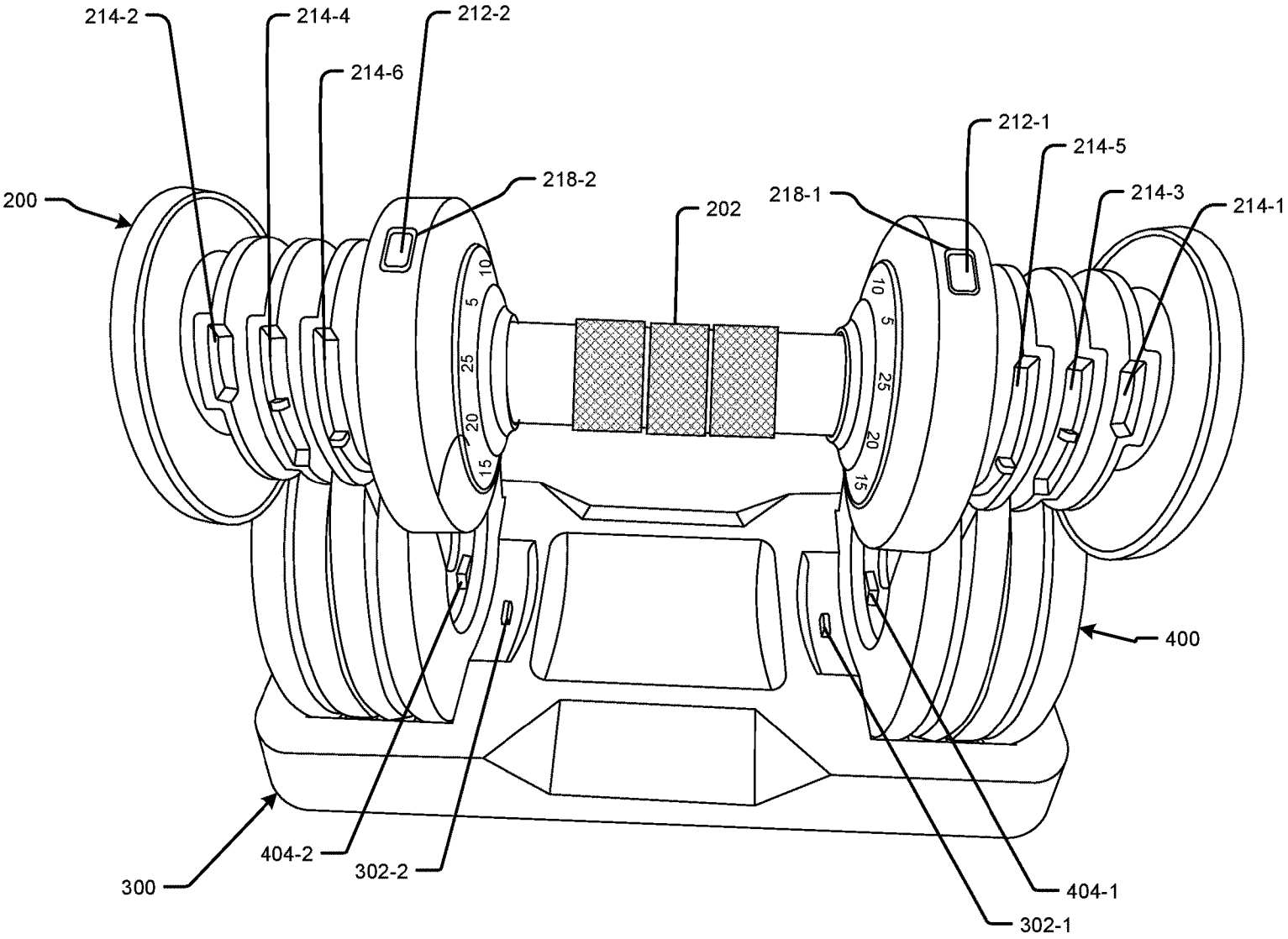
FIG. 4 illustrates views of the handle and the nesting tray showing a locking mechanism of the adjustable weight dumbbell device in accordance with an embodiment.

FIG. 4 shows views of the handle 200 and the nesting tray 300 showing a locking mechanism of the adjustable weight dumbbell device and features of the weight plates 400 and selector plates 210 of the handle 200 that facilitate working of the adjustment mechanism of the device 100. The mechanism to facilitate the selection and deselection of the weight plates 400 can include raised tabs, such as raised tabs 214-1, 214-2, 214-3, . . . etc. (hereinafter collectively and individually referred to a raised tabs 214) located on a side of the selector plates 210. For example, the raised tabs 214-1 is located on the selector plate 210-1, the raised tabs 214-2 is located on the selector plate 210-2, and so on. The raised tabs 214 can be concentrically located and of circular shape, as is evident from FIG. 4, with progressively reducing arc length from the innermost selector plate 210 towards the outermost selector plates 210. Besides, the starting point of the raised tabs 214 on the selector plates 210 can be shifted by a predefined angle from the innermost selector plate 210 to the outermost selector plate 210. The angular shift can be the same as the angular pitch between weight markings 216 on the handle 200, shown in FIG. 1B.

In addition to the raised tabs 214, the adjustment mechanism to facilitate selection and deselection of the weight plates 400 can also include projections, such as one or more projections 404-1 and 404-2 (hereinafter collectively and individually referred to as projection(s) 404) provided on the weight plates. It is to be appreciated that while the projections 404-1 and 404-2 are provided on the two innermost weight plates 400, similar projections 404 are provided on all other weight plates also. The projections 404 can be at a radial distance from the center of the weight plates that is larger than the radial distance of the raised tabs 214 on the selector plates 210 so that when the selector plates 210 rotate in the first direction along with the rotating grip 202, the raised tabs 214 of the one or more selector plates 210, depending on the extent of rotation, get positioned under the projections 404 of the adjacent weight plates 400, thereby engaging those weight plates 400 with the handle 200. Similarly, when the selector plates 210 rotate in the opposite direction, referred to as the second direction, the one or more selector plates 210 depending on the extent of rotation, move away from the position under the projections 404 of the weight plates 400, thereby disengaging those weight plates 400 with the handle 200.

As can be understood, the progressively located raised tabs 214, i.e., the progressively located starting point of the raised tabs 214, results in engagement of one additional weight plate 400 with the handle 200 on each side of the handle 200 with incremental rotation of the rotating grip 202 in the first direction by the predefined angle, i.e., the angular shift in the starting point of the raised tabs 214. Similarly, incremental rotation of the rotating grip 202 in the second direction by the predefined angle can result in disengagement of one weight plate 400 with the handle 200 on each side of the handle 200.

In an embodiment, the handle 200 can include a locking mechanism configured to lock the rotating grip 202 with the hubs 204 in the selected positions to prevent rotation of the rotating grip 201 in the first or second direction. The locking mechanism is configured to lock the rotating grip 202 in the selected positions when the handle 202 is lifted off the nesting tray 300. On the other hand, when the handle 200 is placed on the nesting tray 300, the locking mechanism can unlock the rotating grip 202 to allow the rotating grip 202 to be rotated in the first or second direction.

As shown in FIG. 4, the locking mechanism can include one or more locking tabs, such as locking tabs 212-1 and 212-2 (hereinafter individually and collectively referred to as locking tab(s) 212) located on an outer periphery of the hubs 204 angularly opposite the bridges 208, i.e., at the lower-most point of the hubs 204. The locking tabs 212 are configured such that, when the handle is placed on the nesting tray, the locking tabs 212 move radially inward to unlock the rotating grip 202. The locking tabs 212 can be spring-biased to move radially outward when the handle 202 is moved away from the nesting tray 300 to lock the rotating grip 202.

The locking mechanism can further include one or more raised projections, such as raised projections 302-1 and 302-2 (hereinafter collectively and individually referred to as raised projection(s) 302), in positions corresponding to the locking tabs 212 such that, when the handle 200 is placed on the nesting tray 303, the raised projections 302 engage with the corresponding locking tabs 212 to move the locking tabs 212 radially inward within corresponding locking recesses, such as locking recesses 218-1 and 218-2 (hereinafter collectively referred to as locking recesses 218) in the hubs 204. Thus, the locking mechanism works automatically without any manual intervention to lock the rotating grip 202 when the handle 200 is lifted off the nesting tray 300 and unlocking the rotating grip 202 when the handle 200 is placed on the nesting tray 300 to allow rotation of the rotating grip 202 for change in weight of the handle 200.

The raised projections 302 on the nesting tray 300 and the corresponding locking recesses 218 on the hubs 204 can be configured such that, when the handle 200 is placed over the nesting tray 300, the raised projections 302 engage with the corresponding locking recesses 218 to prevent rotation of the hubs 204 along with the rotating grip 202 when the rotating grip 202 is rotated in the first or second direction to the selected positions. This can enable the rotating grip 202 to be rotated by a single hand without having to hold the hubs 204.

In an embodiment, the adjustment mechanism can include an electric motor (not shown here) to rotate the rotating grip 202 in the first or second direction, and a control system with wireless connectivity to allow remote actuation of the electric motor to rotate the rotating grip 202 to the first or second direction to a selected position. Using the control system through a personal device, such as but not limited to a smartphone or a tablet, or a smart home device, the user can adjust the desired weight via a preprogrammed workout or a manual input to the personal device or a voice command on the smart home device.

Figure 5:
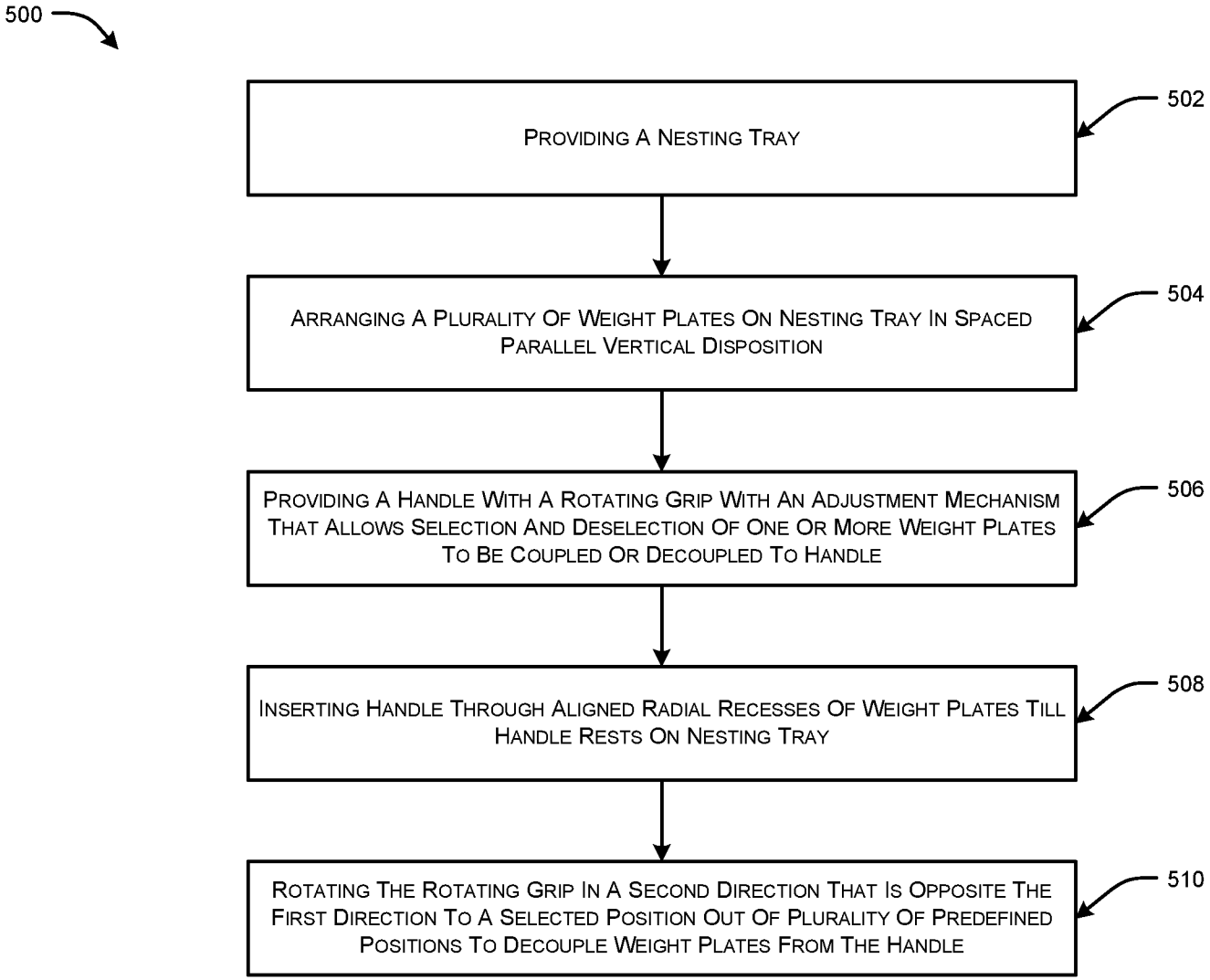
FIG. 5 is an exemplary block diagram for the proposed method for adjusting the weight of a dumbbell in accordance with an embodiment.

Referring to FIG. 5, where a block diagram for the proposed method for adjusting the weight of a dumbbell is shown, the method 500 for adjusting the weight of a dumbbell can include, at step 502, providing a nesting tray, such as the nesting tray 300 shown in FIG. 3. Step 504 of the method 500 can be to arrange a plurality of weight plates, such as weight plates 400 shown in FIG. 3. on the nesting tray 300 in a spaced parallel vertical disposition such that radial recesses, such as recesses 402 shown in FIG. 4, provided on the weight plates 400 are aligned to each other. Step 506 can be to provide a handle with a rotating grip, such as handle 200 shown in FIG. 2 with the rotating grip 202. The handle 200 can include an adjustment mechanism coupled to the rotating grip 202 that allows selection and deselection of one or more weight plates 400 out of the plurality of weight plates 400 to be coupled to the handle 200.

Step 508 of the method 500 can be to insert the handle 200 through the aligned radial recesses 402 of the weight plates until the handle 200 rests on the nesting tray 300, and step 510 can be to rotate the rotating grip 202 in a first direction to a selected position out of a plurality of predefined positions to engage a set of selected weight plates 400 that correspond to the selected predefined position, with the handle 200, which results in the selected weight plates 400 moving out of the nesting tray 300 along with the handle 200 when the handle 200 is moved away from the nesting tray 300.

The method can further include the step of rotating the rotating grip 202 in a second direction that is opposite the first direction, to a selected position out of the plurality of predefined positions, after the handle 200 has been inserted through the aligned radial recesses 402 of the weight plates 400 to rest on the nesting tray 300, to disengage the engaged weight plates 400 that are in excess of the weight plates 400 corresponding to the selected position, getting disengaged from the handle 200, which results in the excess weight plates 400 remaining on the nesting tray 300 when the handle 200 is moved away from the nesting tray 300.

The method can further include the step of locking the rotating grip 202 in the selected positions when the handle 200 is lifted off the nesting tray 300 to prevent rotation of the rotating grip 202 in the first or second direction. The handle 200 includes a locking mechanism configured to automatically lock the handle grip 202 in the selected position when the handle 200 is lifted off the nesting tray 300.

The method can further include the step of unlocking the rotating grip 202 when the handle 200 is placed on the nesting tray 300 to allow rotation of the rotating grip 202 in the first or second direction. The locking mechanism is configured to automatically unlock the handle grip 202 when the handle 200 is placed on the nesting tray 300.

The method can further include the step of allowing rotation of the rotating grip 202 using a single hand by arresting rotation of a pair of hubs, such as hubs 204 shown in FIG. 2, to which the rotating grip 202 is rotatably configured. The locking mechanism is configured to prevent rotation of the hubs 204 when the handle 200 is placed over the nesting tray 300.

Thus, the present disclosure provides an improved adjustable weight dumbbell device that overcomes many drawbacks of conventional adjustable weight dumbbell devices for exercising. The disclosed device 100 includes an adjustment mechanism that works based on the rotation of a rotating grip 202 to select or deselect weights for getting coupled to a handle 200. The disclosed adjustable weight dumbbell device 100 requires the use of only one hand to adjust the weight of the dumbbell and is compact, that is, it does not require much space to store the multiple weights. The disclosed adjustable weight dumbbell device 100 also does not require manual locking and unlocking of the selected weights.

The adjustable dumbbell of the present invention may be sold wherever traditional dumbbells are sold as well as wherever exercise equipment generally is sold. The adjustable dumbbell of the present invention can be sold individually or with additional other products used for exercising, including but not limited to traditional dumbbells, kettlebells, jump ropes, fitness mats, wrist or ankle weights, and resistance bands. The adjustable dumbbell can also be sold with access to preprogrammed workouts. For instance, the preprogrammed workouts could be accessed via manual input on a smart device, such as a smartphone, tablet, or computer, or via a smart home device.

While the foregoing describes various embodiments of the invention, other and further embodiments of the invention may be devised without departing from the basic scope thereof. The scope of the invention is determined by the claims that follow. The invention is not limited to the described embodiments, versions, or examples, which are included to enable a person having ordinary skill in the art to make and use the invention when combined with information and knowledge available to the person having ordinary skill in the art.

The invention claimed is:

1. An adjustable weight dumbbell device, the device comprising:

a nesting tray;

a plurality of weight plates, each of the weight plates having a radial recess and positioned parallel to each other on the nesting tray such that the radial recesses of the plurality of weight plates are aligned to each other; and a handle with a grip;

wherein the handle comprises an adjustment mechanism coupled to the grip such that rotating the grip in a first direction to one of a plurality of predefined weight markings, after the handle has been inserted through the aligned radial recesses of the weight plates to rest on the nesting tray, results in a set of selected number of weight plates that correspond to a selected predefined weight marking, getting engaged with the handle, which engagement results in the set of selected number of weight plates moving out of the nesting tray along with the handle when the handle is moved away from the nesting tray, and wherein rotating the grip in a second direction that is opposite the first direction to a second predefined weight marking results in the number of weight plates that are in excess of the weight corresponding to the second predefined weight marking getting disengaged from the handle, which disengagement results in the excess weight plates being retained on the nesting tray when the handle is moved away from the nesting tray.

2. The adjustable weight dumbbell device as claimed in claim 1, wherein the nesting tray includes a plurality of slots configured to hold the weight plates in spaced parallel, vertical disposition, equally distributed on two sides of the nesting plate with space in between to accommodate the grip.

3. The adjustable weight dumbbell device as claimed in claim 2, wherein the handle comprises a pair of hubs configured on two sides of the handle such that the grip rotates in the first direction and the second direction relative to the pair of hubs, the pair of hubs being configured to rest on the nesting tray in the space between the weight plates distributed on the two sides of the nesting tray.

4. The adjustable weight dumbbell device as claimed in claim 3, wherein at least one of the pair of hubs includes a plurality of weight markings, each marking including a weight of the handle as a result of a corresponding number of weight plates getting engaged with the handle.

5. The adjustable weight dumbbell device as claimed in claim 3, wherein the adjustment mechanism comprises a plurality of selector plates coupled to the grip for rotation along with the grip, the selector plates being located on the two sides of the handle beyond the pair of hubs in spaced parallel disposition such that, when the handle is positioned over the nesting tray, the selector plates get located in space between adjacent weight plates concentric to the weight plates.

6. The adjustable weight dumbbell device as claimed in claim 5, wherein the selector plates have raised tabs on a side of the selector plates which, when the selector plates rotate along with the grip in the first direction, engage with one or more projections on the adjacent weight plate, thereby resulting in the corresponding number of weight plates getting coupled to the handle for moving out of the nesting tray along with the handle when the handle is moved from the nesting tray.

7. The adjustable weight dumbbell device as claimed in claim 6, wherein the raised tabs are progressively located on the selector plates such that additional rotation of the grip by a predefined angle results in engagement of one additional weight plate with the handle on each side of the handle.

8. The adjustable weight dumbbell device as claimed in claim 3, wherein the handle includes a locking mechanism configured to lock the grip with the pair of hubs in a selected position to prevent rotation of the grip in the first or second direction.

9. The adjustable weight dumbbell device as claimed in claim 8, wherein the locking mechanism is configured to lock the grip in the selected position when the handle is lifted off the nesting tray.

10. The adjustable weight dumbbell device as claimed in claim 8, wherein when the handle is placed on the nesting tray, the locking mechanism unlocks the grip to allow the grip to be rotated in the first or second direction.

11. The adjustable weight dumbbell device as claimed in claim 8, wherein the locking mechanism comprises one or more locking tabs located on an outer periphery of the pair of hubs such that, when the handle is placed on the nesting tray, the locking tabs move radially inward to unlock the grip.

12. The adjustable weight dumbbell device as claimed in claim 11, wherein the locking tabs are spring-biased to move radially outward when the handle is moved away from the nesting tray to lock the grip.

13. The adjustable weight dumbbell device as claimed in claim 11, wherein the nesting tray comprises one or more raised projections in positions corresponding to the locking tabs such that, when the handle is placed on the nesting tray, the raised projections engage with the corresponding locking tabs to move the locking tabs radially inward within corresponding locking recesses in the pair of hubs.

14. The adjustable weight dumbbell device as claimed in claim 13, wherein the raised projections on the nesting tray and the corresponding locking recesses on the pair of hubs are configured such that, when the handle is placed over the nesting tray, the raised projections engage with the corresponding locking recesses to prevent rotation of the pair of hubs as the grip is rotated in the first or second direction to the selected weight markings, which enables the grip to be rotated by a single hand without having to hold the pair of hubs.

15. A method for adjusting the weight of a dumbbell, the method comprising the steps of:

providing a nesting tray;

arranging a plurality of weight plates on the nesting tray in a spaced parallel vertical disposition such that radial recesses provided on the weight plates are aligned to each other;

providing a handle with a grip, the handle comprising an adjustment mechanism coupled to the grip that allows selection and deselection of one or more set of weight plates out of the plurality of weight plates to be coupled to the handle;

inserting the handle through the aligned radial recesses of the weight plates until the handle rests on the nesting tray; and rotating the grip in a first direction to a selected weight marking out of a plurality of predefined weight markings, wherein rotation of the grip in the first direction results in a set of selected number of weight plates that correspond to a selected predefined weight marking, getting engaged with the handle, which engagement results in the set of selected number of weight plates moving out of the nesting tray along with the handle when the handle is moved away from the nesting tray, and wherein rotating the grip in a second direction that is opposite the first direction to a second predefined weight marking results in the engaged number of weight plates that are in excess of the weight corresponding to the second predefined weight marking getting disengaged from the handle, which disengagement results in the excess weight plates being retained on the nesting tray when the handle is moved away from the nesting tray.

16. The method as claimed in claim 15, comprising the step of: locking the grip in the selected weight marking when the handle is lifted off the nesting tray to prevent rotation of the grip in the first or second direction, wherein the handle includes a locking mechanism configured to automatically lock the grip in the selected weight marking when the handle is lifted off the nesting tray.

17. The method as claimed in claim 16, comprising the step of: unlocking the grip when the handle is placed on the nesting tray to allow rotation of the grip in the first or second direction, wherein the locking mechanism is configured to automatically unlock the grip when the handle is placed on the nesting tray.

18. The method as claimed in claim 17, comprising the step of: allowing rotation of the grip using a single hand by arresting rotation of a pair of hubs to which the grip is rotatably configured, wherein the locking mechanism is configured to prevent rotation of the pair of hubs when the handle is placed over the nesting tray.

* * * * *